United States Patent [19]

Kohama et al.

[11] 4,215,988

[45] Aug. 5, 1980

[54] RESIST PRINTING METHOD

[75] Inventors: Kazuo Kohama, Kyoto; Akira Hashimoto, Osaka; Junichi Nakamura, Kyoto; Kazuo Tao, Shiga, all of Japan

[73] Assignee: Meisei Chemical Works, Ltd., Kyoto, Japan

[21] Appl. No.: 951,884

[22] Filed: Oct. 16, 1978

[30] Foreign Application Priority Data

Oct. 20, 1977 [JP] Japan ..... 52-127119

[51] Int. Cl.[2] ..... C09B 49/00

[52] U.S. Cl. ..... 8/448

[58] Field of Search ..... 8/1 A, 65

[56] References Cited

U.S. PATENT DOCUMENTS

| | | | |
|---|---|---|---|
| 3,663,157 | 5/1972 | Gilgien et al. | 8/65 |
| 3,700,402 | 10/1972 | Noda et al. | 8/65 |

*Primary Examiner*—Lewis T. Jacobs

*Attorney, Agent, or Firm*—Morgan, Finnegan, Pine, Foley & Lee

[57] ABSTRACT

This invention relates to a resist printing method utilizing of different reactivities of reactive dyestuffs. The development or fixation of a vinyl sulfone type reactive dyestuff in a fibrous material is prevented with the use of a resist printing paste comprising at least one compound which have the following general formula:

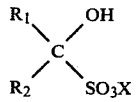

wherein $R_1$ is hydrogen, an alkyl group or an aryl group, $R_2$ is an alkyl group, an aryl group,

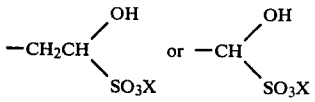

and X is an alkali metal or an amine.

10 Claims, No Drawings

RESIST PRINTING METHOD

BACKGROUND OF THE INVENTION

This invention relates to a resist printing method utilizing different reactivities of reactive dyestuffs, and particularly relates to a resist printing method for vinyl sulfone type reactive dyestuffs.

Reactive dyestuffs have been used preferably for a fast color dyeing of such materials as polyamide synthetic fiber, wool, cotton, hemp, viscose rayon, cuprammonium rayon and cellulose acetate. The use of such reactive dyestuffs for a fast color dyeing sometimes has required a resist printing. However, since an acid material, such as tartaric acid, is used as a resist in the prior art, alkali materials contained in a reactive dyestuff composition as an essential element, are neutralized. This neutralization of the alkali materials prevents development of every reactive dyestuff. Consequently, white resist printing can be achieved but color resist printing cannot be carried out with the combination of plural reactive dyestuffs. Accordingly, the aforementioned prior art method is not substantially useful.

A colored resist printing method is disclosed in Japanese Patent Publication No. 12,877 of 1969, in which alkali hydroxymethanesulfonate was used as a resist printing agent for vinyl sulfone type reactive dyestuffs to make the combination of reactive dyestuffs useful in a colored resist printing. However, the dyestuffs used in this method are limited and this method cannot be applied to the resist printing for dark colored dyestuffs such as black and dark blue. Further, if the printed pattern of the resist printing paste is allowed to stand or dried, a good resist effect is not expected. Accordingly, the resisted dyestuff must be applied subsequently to print the resist printing paste without drying. This is a problem in workability.

An object of this invention is to provide a new method for resist printing with use of reactive dyestuffs.

Another object of this invention is to provide a method for resist printing which effectively prevents development of the dark colored reactive dyestuffs.

A further object of this invention is to provide a method for resist printing which is superior in workability.

SUMMARY OF THE INVENTION

In this invention the development or fixation of a vinyl sulfone type reactive dyestuff in a fibrous material is prevented with the use of a resist printing paste comprising at least one compound which has the following general formula:

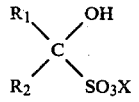

(I)

wherein $R_1$ is hydrogen, an alkyl group or an aryl group, $R_2$ is an alkyl group, an aryl group,

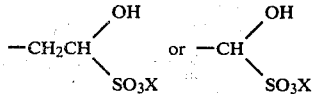

and X is an alkali metal or an amine.

The compound having the formula (I) is easily produced by the addition reaction of an aldehyde or ketone such as acetaldehyde, butylaldehyde, benzaldehyde, glyoxal, malonaldehyde, acetone, methyl ethyl ketone and acetophenone with an acid alkali sulfite or acid amine sulfite as indicated in the following reactions:

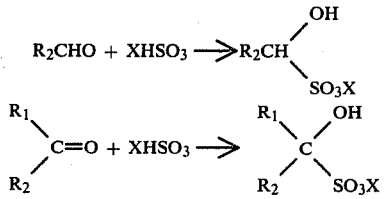

The chain length of $R_1$ and $R_2$ is not limited, but the preferable alkyl group is that having 1 to 6 carbon atoms and the preferable aryl group is phenyl or phenyl derivatives. As X, there are preferably included sodium, potassium, lithium and tertiary amine, selected from the group consisting of trialkyl amines, trialkanol amines and alkanol amines whose alkyl or alkanol group has 1 to 4 carbon atoms, respectively.

DETAILED DESCRIPTION OF THE INVENTION

In this invention, compound (I) is admixed with a paste to prepare a resist printing paste. The resist printing paste is printed to a fibrous material and then a dye liquid or paste comprising a vinyl sulfone type reactive dyestuff is applied to the resist printed fibrous material whereby the development of the vinyl sulfone type reactive dyestuff printed on the resist printing paste is prevented. According to the invention the reactivity of compound (I) with vinyl sulfone type reative dyestuffs is utilized. Since compound (I) is easily reacted with vinyl sulfone type reactive dyestuffs, the vinyl sulfone type reactive dyestuff printed on the resist printing paste is reacted thoroughly with compound (I) prior to reaching the surface of the fibrous material. As a result, the vinyl sulfone type reactive dyestuff cannot be developed and fixed to the fibrous material. Thus a superior resist printing is attained in the invention.

The content of compound (I) in the resist printing paste is freely selected. Generally, one % by weight of compound (I) is preferably contained and 2 to 3% by weight of compound (I) is more preferably.

Compound (I) hardly reacts with dyestuffs other than from vinyl sulfone type reactive dyestuffs and if compound (I) is reacted with such other dyestuffs the reaction is very slow. Accordingly, the resist printing paste according to the invention is very useful for either white resist printing or colored resist printing. The colored dyestuffs included in the resist printing paste are not particularly limited. Compound (I) does not substantially prevent the reactivity of monochlorotriazine, trichloropyrimidine and dichloroquinoxaline dyestuffs, reactive dyestuffs similar to vinyl sulfone type dyestuffs, the development of the vinyl sulfone type dyestuffs being prevented with compound (I). So the resist printing paste according to the invention preferably comprises at least one of these reactive dyestuffs to produce a clear colored resist printing.

Further, since compound (I) is superior in heat stability and is stable to drying, a vinyl sulfone type reactive dyestuff can be applied to the printed fibrous material with the resist printing paste in the invention either after or before drying the paste. If a vinyl sulfone type dyestuff is applied after drying the resist printing paste at 100° C. to 150° C., the resist printing is carried out very effectively. Further, as compound (I) is very reactive, the resist printing paste according to the invention can prevent the development or fixation of all vinyl sulfone type dyestuffs including dark and light colored dyestuffs. Accordingly, the method of the invention is superior in workability and has extensive applications.

PREFERRED EMBODIMENTS OF THE INVENTION

The following examples are given in order to illustrate the invention without limiting the same. Unless otherwise indicated, the amounts of the components are designated in parts or % by weight.

EXAMPLE 1

30 Parts of Kayacion Yellow-4G(manufactured by Nippon Kayaku Co., Ltd.) and 50 parts of urea were dissolved in 170 parts of hot water and then mixed with 500 parts of 5% sodium alginate to form a first mixture. To the first mixture, 10 parts of sodium-m-nitrobenzenesulfonate and 20 parts of sodium hydrogen carbonate were added and admixed uniformly to form a second mixture. Subsequently, 20 parts of glyoxal-acid sodium sulfite dissolved in 200 parts of hot water were added to the second mixture to obtain 1000 parts of a homogeneous printing paste ($A_1$).

On the other hand, 70 parts of Remazol Black B (manufactured by Hoechst Aktiengesellshaft) and 50 parts of urea were dissolved in 350 parts of hot water, and mixed with 500 parts of 5% sodium alginate. To the mixture 10 parts of sodium m-nitrobenzenesulfonate and 20 parts of sodium hydrogen carbonate were added and admixed homogeneously to prepare 1000 parts of a printing paste ($B_1$).

The paste ($A_1$) was printed on a cotton broad cloth and then the paste ($B_1$) was printed on the cotton broad cloth so that the printed pattern of the paste ($A_1$) was partly covered with the paste ($B_1$). The printed cloth was steamed at 100° C. for 10 minutes, rinsed with water and then with warm water, soaped and rinsed with water. There was obtained a good printed cloth in which a yellow pattern and a black pattern were distinguished respectively without admixing the colors in the part of which the black paste ($B_1$ was printed on the yellow paste ($A_1$).

EXAMPLE 2

Example 1 was repeated except that the cloth printed with the paste ($A_1$) was dried at 100° C. prior to the printing with the paste ($B_1$). A printed cloth superior in resist printability was obtained as in Example 1.

According to Examples 1 and 2, it is found that glyoxal-acid sodium sulfite could be effectively used for resist printing in the state of either wet or dry.

EXAMPLE 3

Example 1 and Example 2 were repeated with the use of seven compounds indicated in Table I instead of glyoxal-acid sodium sulfite adduct to examine the resist-printability and the heat resistance of each compound.

TABLE I.

| Compounds | | | | Resist-print-ability | Heat resistance |
|---|---|---|---|---|---|
| No. | General formula | $R_1$ | $R_2$ | | |
| 1 | $R_1$, $R_2$, C, OH, $SO_3Na$ | —H | —$CH_3$ | ○ | X |
| 2 | | —H | —$C_4H_9$ | ◎ | ○ |
| 3 | | —H | 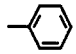 | ◎ | ○ |
| 4 | | —$CH_3$ | —$CH_3$ | ○ | ○ |
| 5 | | —$CH_3$ | —$C_2H_5$ | ◎ | ○ |
| 6 | | —$CH_3$ | 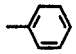 | ◎ | ○ |
| 7 | | —H | —H | X | X |

Resist-printability: tested for Remazol Black B (manufactured by Hoechst Aktiengesellshaft).
◎-very good
○-good
X -bad
Heat resistance: acceptability of heat drying step each compound.
○-superior in resist printability in the state of either wet or dry.
X-bad in resist printability after drying other resist printing paste.

EXAMPLE 4

30 Parts of Cibacron Brilliant Red BD (manufactured by Ciba-Geigy Corporation) and 150 parts of urea were dissolved in 180 parts of hot water and then mixed with 500 parts of 5% sodium alginate. To the obtained mixture 10 parts of sodium m-nitrobenzenesulfonate and 20 parts sodium hydrogen carbonate were added. A solution of 10 parts of benzaldehyde-sodium hydrogen sulfate adduct in 100 parts of hot water was then added to the obtained mixture to prepare 1000 parts of a homogeneous paste ($A_2$).

30 Parts of Remazol Brilliant Blue R (manufactured by Hoechst Aktiengesellshaft) and 150 parts of urea were dissolved in 290 parts of hot water and admixed with 500 parts of 5% sodium alginate. Further, 10 parts of sodium m-nitrobenzene sulfonate and 20 parts of sodium hydrogen carbonate were added to the mixture to prepare 1000 parts of a printing paste ($B_2$).

The paste ($A_2$) was printed on a cotton satin cloth and then the paste ($B_2$) was printed on the cloth so that a part of the printed pattern of the paste ($A_2$) was covered with the paste ($B_2$). The printed cloth was dried at 150° C. for 3 minutes, rinsed with water and then warm water, soaped and rinsed with water. As a result, there was obtained a clear colored satin having a blue area containing a red inset.

EXAMPLE 5

Example 4 was repeated except to use seven compounds indicated in Table II instead of benzaldehyde-sodium hydrogen sulfite adduct to examine the resist-printability and the heat resistance of the compounds. The heat resistance was examined in the same manner as Example 4, in which the cloths were dried after printing the paste ($A_2$).

TABLE II.

| Compounds | | | | Resist-print-ability | Heat resis-tance |
|---|---|---|---|---|---|
| No | General Formula | $R_1$ | $R_2$ | | |
| 1 | $R_1$, $R_2$, C, OH, $SO_3Na$ | —H | —$CH_3$ | ○ | X |
| 2 | | —H | —$C_4H_9$ | ◎ | ○ |

TABLE II.-continued

| Compounds | | | | Resist-print-ability | Heat resis-tance |
|---|---|---|---|---|---|
| No | General Formula | $R_1$ | $R_2$ | | |
| 3 | | —H | —CH(OH)—$SO_3Na$ | ◎ | ○ |
| 4 | | —$CH_3$ | —$CH_3$ | ○ | ○ |
| 5 | | —$CH_3$ | —$C_2H_5$ | ◎ | ○ |
| 6 | | —$CH_3$ | 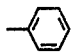 | ◎ | ○ |
| 7 | | —H | —H | X | X |

EXAMPLE 6

30 Parts of Cibracon Scarlet RP (manufactured by Ciba-Geigy Corporation) and 50 parts of urea were dissolved thoroughly in 180 parts of hot water and then mixed with 500 parts of 5% sodium alginate. To the obtained mixture, 20 parts of sodium m-nitrobenzenesulfonate and 20 parts of sodium hydrogen carbonate were added and further 40 parts of sodium hydroxymethanesulfonate and 10 parts of glyoxalacid sodium sulfite were added to obtain 1000 parts of a homogeneous printing paste ($A_3$).

70 Parts of Remazol Black B (manufactured by Hoechst Aktiengesellshaft) and 50 parts of urea were dissolved in 350 parts of hot water and admixed with 500 parts of 5% sodium alginate. To the obtained mixture 10 parts of sodium m-benzenesulfonate and 20 parts of sodium hydrogen carbonate were added to prepare a homogeneous printing paste ($B_3$).

The paste ($A_3$) was printed on a cotton broad cloth and then the paste ($B_3$) was printed on the cotton broad thoroughly. After drying the printed cloth was steamed at 100° C. for 10 minutes, rinsed with water and then warm water, soaped and rinsed with water to obtain a black cloth containing a clear red inset.

EXAMPLE 7

20 Parts of glyoxal-acid triethanolamine sulfite adduct was dissolved in 480 parts of hot water and admixed with 500 parts of 5% sodium alginate uniformly to prepare a printing paste ($A_4$).

The paste ($A_4$) was printed on a cotton satin cloth and then the paste ($B_1$) prepared in Example 1 was printed on the satin cloth thoroughly. After drying the satin cloth was steamed at 100° C. for 10 minutes, rinsed and after-treated to obtain a black cloth containing a clear white design.

EXAMPLE 8

Example 6 was repeated except to use the following three compounds instead of glyozal-acid sodium sulfite;
glyoxal-acid tributylamine sulfite adduct,
benzaldehyde-acid diethanolbutylamine sulfite adduct and
benzaldehyde-acid tripropylamine sulfite adduct.
There were obtained black cloths containing a clear red inset as in Example 6.

EXAMPLE 9

Example 7 was repeated except to use the following three compounds instead of glyoxal-acid triethanolamine sulfite adduct:
glyoxal-acid tributylamine sulfite adduct,
benzaldehyde-acid diethanolbutylamine sulfite adduct and
butylaldehyde-acid tripropylamine sulfite adduct.
There were obtained white resist printed cloths superior in whiteness.

What we claim is:

1. A method for preventing development or fixation of a vinyl sulfone type reactive dyestuff in a fibrous material characterized in using a resist printing paste which comprises at least one compound having the following general formula:

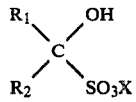

wherein $R_1$ is hydrogen, an alkyl group or an aryl group, $R_2$ is an alkyl group, an aryl group,

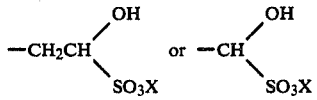

and X is an alkali metal or an amine.

2. A method as defined in claim 1, wherein at least one of $R_1$ or $R_2$ of said compound is an alkyl group having 1 to 6 carbon atoms.

3. A method as defined in claim 1 or 2, wherein X of said compound is sodium, potassium or a tertiary amine selected from the group consisting of trialkyl amines trialkanol amines and alkyl alkanol amines whose alkyl or alkanol group has 1 to 4 carbon atoms, respectively.

4. A method as defined in claim 1, wherein said compound has $R_1$ of hydrogen, or methyl group, and $R_2$ of an alkyl group having 1 to 4 carbon atoms, phenyl group or

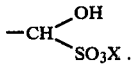

5. A method as defined in claims 1, 2 or 4, wherein said resist printing paste further comprises at least one dyestuff other than vinyl sulfone type reactive dyestuffs.

6. A method as defined in claim 5, wherein said resist printing paste comprises at least one selected from the group consisting of monochlorotriazine dyestuffs, trichloropyrimidine dyestuffs and dichloroquinoxaline dyestuffs.

7. A method as defined in claims 1, 2 or 4, wherein said resist printing paste is printed on said fibrous material and subsequently a liquid or paste comprising vinyl sulfone type reactive dyestuff is applied on said fibrous material.

8. A method as defined in claims 1, 2 or 4, wherein said resist printing paste is printed on said fibrous material and dried, and then a liquid or paste comprising a vinyl sulfone type reactive dyestuff is applied on said fibrous material.

9. A method as defined in claim 5, wherein said resist printing paste is printed on said fibrous material and subsequently a liquid or paste comprising vinyl sulfone type reactive dyestuff is applied on said fibrous material.

10. A method as defined in claim 5, wherein said resist printing paste is printed on said fibrous material and dried, and then a liquid or paste comprising a vinyl sulfone type reactive dyestuff is applied on said fibrous material.

* * * * *